US006619066B1

(12) United States Patent
Kaneo

(10) Patent No.: US 6,619,066 B1
(45) Date of Patent: Sep. 16, 2003

(54) HEAT PUMP SYSTEM OF COMBINATION OF AMMONIA CYCLE CARBON DIOXIDE CYCLE

(75) Inventor: Hidetoshi Kaneo, Shizuoka (JP)

(73) Assignee: Hachiyo Engineering Co., Ltd., Yaizu (JP)

( * ) Notice: Subject to any disclaimer, the term of this patent is extended or adjusted under 35 U.S.C. 154(b) by 0 days.

(21) Appl. No.: 09/914,177

(22) PCT Filed: Sep. 30, 1999

(86) PCT No.: PCT/JP99/05368

§ 371 (c)(1),
(2), (4) Date: Aug. 23, 2001

(87) PCT Pub. No.: WO00/50822

PCT Pub. Date: Aug. 31, 2000

(30) Foreign Application Priority Data

Feb. 24, 1999 (JP) ..... 11/046559
Jun. 14, 1999 (JP) ..... 11/167429

(51) Int. Cl.[7] ..... F25B 13/00

(52) U.S. Cl. ..... 62/324.2; 62/114; 62/333; 62/502

(58) Field of Search ..... 62/335, 434, 114, 62/324.2, 333, 267, 498, 502

(56) References Cited

U.S. PATENT DOCUMENTS 4,205,532 A * 6/1980 Brenan ..... 62/115
5,327,745 A * 7/1994 Gilmour ..... 62/467
5,400,615 A 3/1995 Pearson
5,442,931 A * 8/1995 Ryan et al. ..... 62/101
5,490,390 A * 2/1996 Boyette et al. ..... 62/9
5,507,158 A 4/1996 Bernier
5,524,442 A * 6/1996 Bergman, Jr. et al. ..... 62/86
6,000,233 A * 12/1999 Nishida et al. ..... 62/114
6,073,454 A * 6/2000 Spauschus et al. ..... 62/114

FOREIGN PATENT DOCUMENTS

| | | |
|---|---|---|
| DE | 43 15 924 | 11/1994 |
| EP | 0 675 331 | 10/1995 |
| JP | 64-38558 | 2/1989 |
| JP | 11-23079 | 1/1999 |

* cited by examiner

*Primary Examiner*—William C. Doerrler
*Assistant Examiner*—Malik N. Drake
(74) *Attorney, Agent, or Firm*—Wenderoth, Lind & Ponack, L.L.P.

(57) ABSTRACT

A heat pump system for cooling (refrigeration) or heating is provided by employing a combination of natural media such as ammonia and $CO_2$. The heat pump system (1) combines an ammonia cycle (2) and a $CO_2$ cycle (3), and the $CO_2$ medium in the $CO_2$ cycle (3) is circulated, by natural circulation due to a difference of fluid heads of the $CO_2$ medium in the cycle without the necessity of incorporating a compressor, and by partial heating or cooling of the cycle. The structural elements of the ammonia cycle (2) are located away from the devices for the desired refrigeration and heating.

16 Claims, 6 Drawing Sheets

HEAT PUMP SYSTEM OF COMBINATION OF AMMONIA CYCLE CARBON DIOXIDE CYCLE

BACKGROUND OF THE INVENTION

1. Technical Field

The present invention relates to a heat pump system in which natural media are employed. More particularly, the present invention relates to a heat pump system using natural media such as ammonia and carbon dioxide and simultaneously accomplishing the economical utility.

2. Description of Related Art

Recently there have been resolutions made at Montreal (Montreal Protocol) and Kyoto (Kyoto Protocol to the United Nations Framework Convention on Climate Change), of which the objective is the disuse or reduction of several types of refrigerant such as chlorofluorocarbon (CFC), hydrochlorofluorocarbon (HCFC) or hydrofluorocarbon (HFC), in order to prevent the ozone layer destruction around the earth or Global Warming. In Japan, CFC, HCFC and HFC are collectively abbreviated as "flon" gas, respectively referred to as "specified flon," "designated flon" and "alternative flon," and their restriction is now under development. CFC has become disused in the end of 1995. HCFC is scheduled to become disused in 2020. Further, the emission of HFC into the atmosphere has become strongly limited. Consequently, it is has become necessary for the heat pump systems in refrigerating or air conditioning installations to use natural media (working fluid) such as ammonia, carbon dioxide, air or water.

The use of ammonia, however, is in many cases restricted due to its toxicity. For example, when ammonia is used for a refrigerator circuit having an evaporator incorporated in a showcase of supermarket or an air conditioning equipment of hotel, since unspecified individuals would visit there, there arises the difficulty of assuring safe and economical use of ammonia.

On the other hand, when carbon dioxide gas is used as the medium, because of its low critical temperature (31.1° C.) and high saturation pressure at normal temperature (for example, about 75 kg/cm$^2$ (abs) at 31.1° C.), carbon dioxide has the disadvantageous point of ineffectiveness when used for air conditioning refrigerant of which evaporation temperature is relatively high. Further, where a compressor is required in order to overcome the problem discussed above, the related apparatus or instruments should be provided with strong pressure durability, consequently the system would become heavier and much expensive. Accordingly, although it has been theoretically possible to provide with an innovative heat pump system such as a dual phase refrigerating system utilizing ammonia and carbon dioxide, since the actual use would incur the problems of heavy weight and high cost, this type of heat pump system is not used in practice.

In the light of technical background and problems as above discussed, it is an object of the present invention to provide a heat pump system capable of cooling (refrigerating) and heating, by using a combination of ammonia and carbon dioxide. Further, since it is known that both ammonia and carbon dioxide are the natural media, existing in the natural environment and are organically recyclable, it is another object of the present invention to provide a heat pump system, which settles the problems of the toxicity in regard to ammonia as well as the high critical pressure at normal temperature in regard to carbon dioxide, and simultaneously to achieve sufficient utility at a lower cost.

SUMMARY OF THE INVENTION

To achieve the objects mentioned above, there is provided a heat pump system which utilizes a combination of an ammonia cycle and a carbon dioxide cycle carrying out refrigeration or heating, by combination of an ammonia cycle using ammonia as the medium and a carbon dioxide cycle using carbon dioxide as the medium. The natural circulation is done in the carbon dioxide cycle without incorporating a compressor.

With this structure, since it is not necessary to incorporate a compressor in the carbon dioxide cycle in order to circulate the carbon dioxide medium, less load power is required, and there is no need for using a large-size pressure vessel, and thus the heat pump system can be provided at a lower cost.

In addition to the elements, as discussed above, the circulation of carbon dioxide medium without incorporating the compressor is achieve, by natural circulation due to the difference of fluid heads of carbon dioxide media in the carbon dioxide cycle, and also by circulation due to heating or cooling of a part of the carbon dioxide cycle.

With this structure, in addition to the natural circulation realized by utilizing the difference of fluid heads, since the carbon dioxide medium is circulated by heating or cooling of a part of the carbon dioxide cycle, the operation can be made reliably and efficiently.

In addition to the elements as discussed above, the carbon dioxide cycle comprises a carbon dioxide refrigeration cycle functioning during cooling and a carbon dioxide heating cycle functioning during heating. The carbon dioxide refrigeration cycle is provided with an evaporator for carrying out the desired refrigeration by vaporizing carbon dioxide, at a position lower than a cascade condenser provided for carrying out cooling and liquefying the carbon dioxide medium. The carbon dioxide heating cycle is provided with a radiator for carrying out the desired heating by condensing carbon dioxide and also serving as the evaporator during refrigeration, at a position higher than a heat absorbing device provided for carrying out heating and vaporizing of carbon dioxide medium. The circulation of carbon dioxide medium in the carbon dioxide cycle is done, by means of cooling and liquefying the carbon dioxide medium in the carbon dioxide refrigeration cycle by the cascade condenser through which the ammonia cycle circulates during refrigeration, and by means of heating and vaporizing the carbon dioxide medium in the carbon dioxide heating cycle by the heat absorbing device during heating.

With this structure, the cascade condenser, as well as the evaporator and radiator serving for the desired refrigeration and heating in the carbon dioxide cycle, may be prepared by using tube or plate.

In addition to the elements as discussed above, the structural elements of the ammonia cycle are placed away from the evaporator or radiator carrying out the desired refrigeration and heating.

With this structure, since the structural elements of the ammonia cycle is placed away from the device carrying out the desired refrigeration and heating, such as on a roof or at any other outdoor space, the safety of the system can be secured.

In addition to the elements as discussed above, a fluid pump is provided for secondarily supporting the circulation of carbon dioxide medium in the carbon dioxide cycle.

With this structure, as compared with a (sensible heat using type of) brine chiller serving the same purpose by using ammonia as a refrigerant, the circulation of carbon dioxide medium can be supported by a considerably smaller amount of load power of the fluid pump, thereby reliable circulation of carbon dioxide medium can be secured.

DETAILED DESCRIPTION OF THE INVENTION

The detailed explanation of the present invention will now be made with reference to the drawings attached hereto, in which embodiments of the present invention are illustrated as a heat pump system 1 by combination of an ammonia cycle and a carbon dioxide cycle. The heat pump system 1 is not limited to a refrigerating system solely used for refrigeration, but may also be applied to various refrigerating and heating apparatus or instruments which selectively perform refrigerating and heating, e.g., an ordinary refrigerator, a showcase refrigerator in a supermarket, and a heating system necessary for air conditioning of a hotel or office building. In the present invention, a first embodiment will be discussed in regard to the heat pump system 1, which is solely applied to a refrigerator, and a second embodiment will be discussed in regard to the heat pump system 1, which is applied to a refrigerating/heating apparatus which selectively performs refrigeration and heating.

FIRST EMBODIMENT

Figure 1:
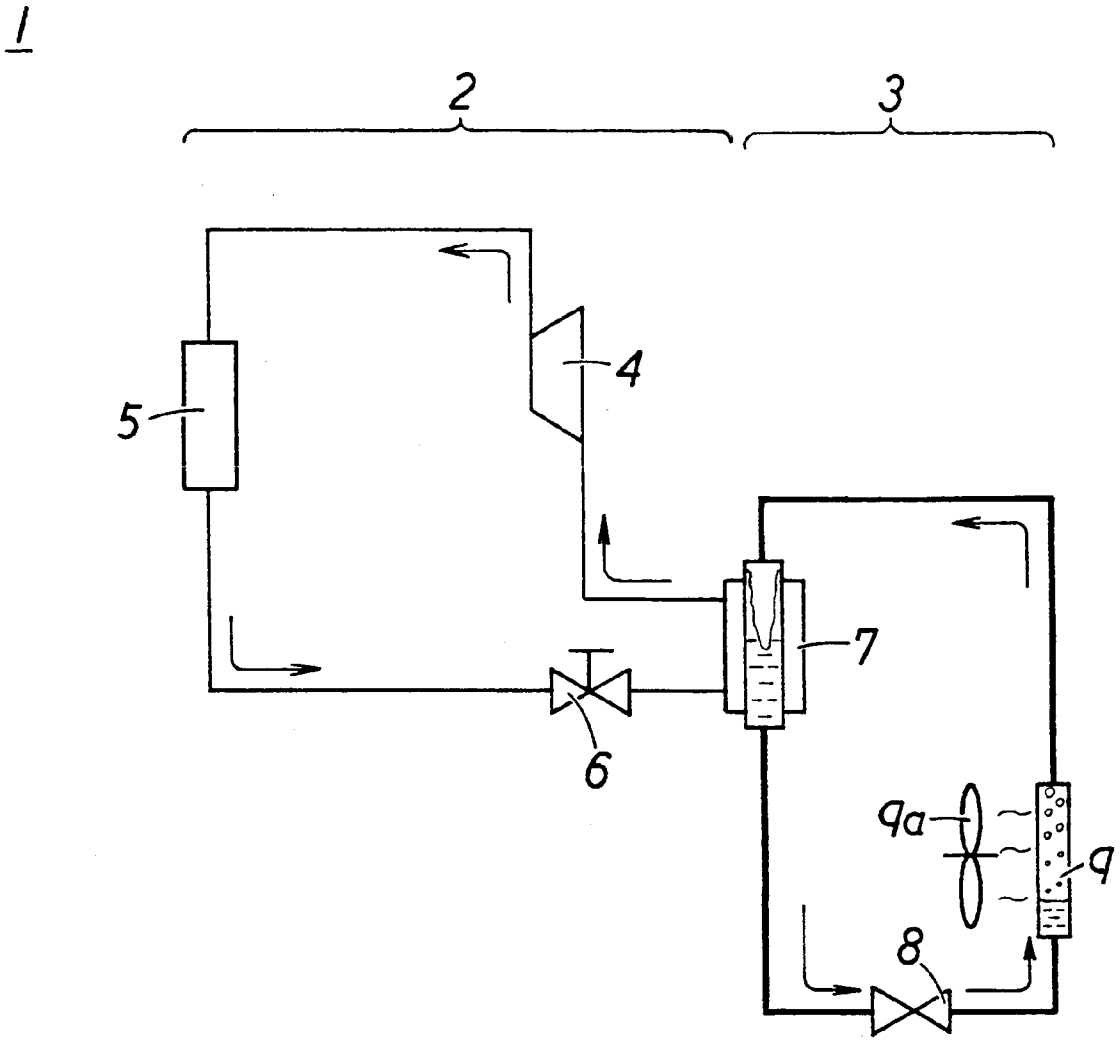
FIG. 1 is a block diagram showing the scheme of heat pump system according to the first embodiment of the present invention.

The heat pump system 1, according to the first embodiment solely carries out refrigeration, and includes an ammonia cycle 2 at an upper phase, and a carbon dioxide cycle at a lower phase as illustrated in FIG. 1.

The ammonia cycle 2 is provided, for example, with a compressor 4, a condenser 5, expansion valve 6 and a cascade condenser 7. The cascade condenser 7 practically plays the role of cooling carbon dioxide existing in the carbon dioxide cycle 3. Since the ammonia cycle 2 uses the toxic ammonia as the working medium, the minimum volume of ammonia has been filled in the ammonia cycle 2, and the structural elements of the ammonia cycle 2 are placed on a roof or at any other outdoor space, away from the corresponding evaporator incorporated in the objective showcase refrigerator.

The carbon dioxide cycle 3 is provided, for example, with the cascade condenser 7 as above discussed, and a flow adjust valve 8 and an evaporator 9. For example, the flow adjust valve 8 and the evaporator 9 are, or only the evaporator 9 is placed indoors, thus the cooling of showcase, etc., is carried out by a fan 9*a* of the evaporator 9. Since the desired cooling is achieved at the evaporator 9, the cascade condenser 7 is positioned higher than the evaporator 9, thus the fluid heads of carbon dioxide medium at the cascade condenser 7 and the evaporator 9 are different.

The cooling function of this heat pump system 1 according to the first embodiment will now be described. At the ammonia cycle 2, gaseous ammonia is compressed by the compressor 4. When the obtained ammonia gas passes through the condenser 5, the ammonia gas is cooled by coolant or air, thus the ammonia becomes liquid. The liquid ammonia is then expanded by the expansion valve 6 until reaching the saturation pressure corresponding to the necessary low temperature, and after that, the ammonia is vaporized by the cascade condenser 7, and becomes ammonia gas again. In the cascade condenser 7, the ammonia takes away the heat of carbon dioxide existing in the carbon dioxide cycle 3, thus the carbon dioxide becomes liquid.

On the other hand, at the carbon dioxide cycle 3, the liquid carbon dioxide, obtained after being cooled by the cascade condenser 7, goes down by natural circulation due to the difference of fluid heads, passes through the flow adjust valve 8, and eventually reaches the evaporator 9 in order to carry out the desired refrigeration. The liquid carbon dioxide is then heated and vaporized at the evaporator 9, and the thus obtained carbon dioxide gas returns to the cascade condenser 7.

The natural circulation by utilizing the difference of fluid heads is known in the prior art. For example, a similar principle is applied to a heat pipe for cooling precision mechanical parts. This kind of heat pipe is, however, limited to that in which the working fluid (medium) solely circulates, and no other cooling function is added to that heat pipe. In this connection, the heat pump system according to the present invention is not limited to the application of natural circulation thereto by utilizing the difference of fluid heads, but also has the characteristic of the active circulation of medium by cooling or heating the carbon dioxide medium through control of fluid circulation volume.

SECOND EMBODIMENT

Figure 2:
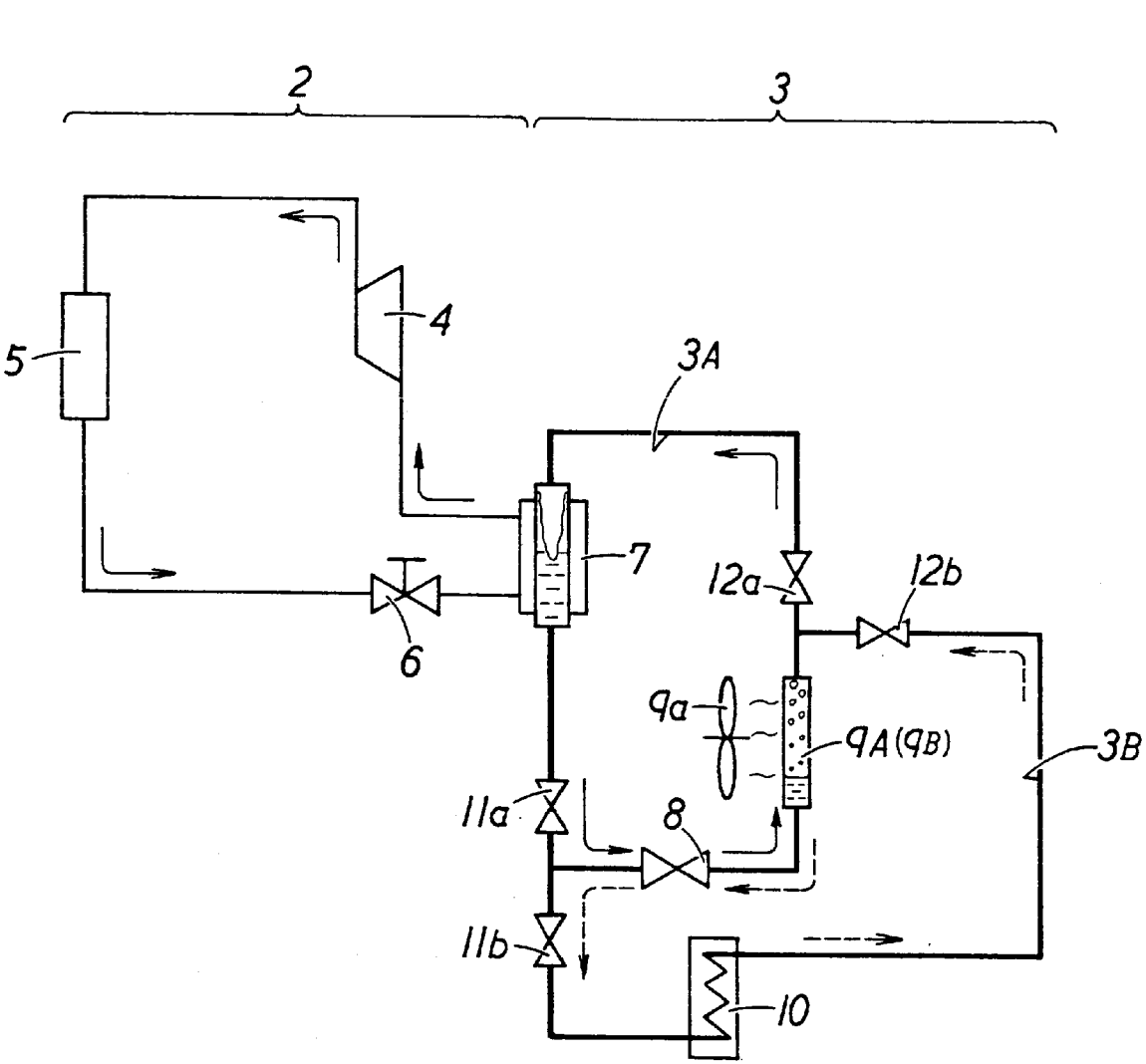
FIG. 2 is a block diagram showing the scheme of heat pump system according to the second embodiment of the present invention.

The second embodiment of the present invention will now be described. The heat pump system 1 according to the second embodiment selectively carries out either refrigeration or heating, by combing the ammonia cycle 2 and the carbon dioxide cycle 3 as illustrated in FIG. 2. The ammonia cycle 2 is substantially the same as that of the first embodiment, so the detailed explanation thereof will not be made here, and the carbon dioxide gas cycle 3 will be discussed in detail.

The carbon dioxide cycle 3 comprises a carbon dioxide refrigeration cycle 3A functioning during cooling and a carbon dioxide heating cycle 3B functioning during heating. The structure of carbon dioxide refrigeration cycle 3A is substantially the same as that of the first embodiment, provided with the cascade condenser 7, the flow adjust valve 8 and the evaporator 9A. The carbon dioxide heating cycle 3B is provided with the flow adjust valve 8, a radiator 9B and a heat absorbing device 10. The heat absorbing device 10 serves to heat and evaporate carbon dioxide inside the carbon dioxide heating system 3B by using, for example, a boiler. Although the evaporator 9A and the radiator 9B is practically the same element, since the function of this element is different between cooling and heating, the different numerals are given to the identical element. The portion connecting the carbon dioxide refrigeration cycle 3A and the carbon dioxide heating cycle 3B is provided, for example, with switch valves 11*a*, 11*b*, 12*a* and 12*b* as illustrated in FIG. 2. The flow adjust valve 8 and the evaporator 9A (i.e. radiator 9B) are, or only the evaporator 9A (i.e. radiator 9B), for example, is placed indoors, thus the desired cooling is carried out by the fan 9*a*. The cascade condenser 7 is positioned at a higher level than the evaporator 9A carrying out the desired cooling, and the heat absorbing device 10 is positioned at a lower level than the radiator 9B carrying out the desired heating. For example, the cascade condenser 7 is placed on the roof, and the heat absorbing device 10 is placed on the basement floor. With this structure, the fluid heads of carbon dioxide medium at the cascade condenser 7 and the evaporator 9A, as well as that at the heat absorbing device 10 and the radiator 9B, are different.

The function of this heat pump system 1 according to the second embodiment will now be described, with reference to the respective cases of cooling operation and heating operation. The arrows in solid line in FIG. 2 show the refrigeration cycle, and those in broken line show the heating cycle.

(1) Cooling Operation

During cooling operation, the ammonia cycle 2 becomes substantially the same state as that of the first embodiment. The switch valves 11*a* and 12*a* are opened, and switch valves 11*b* and 12*b* are closed in the carbon dioxide cycle 3. Thus, only the carbon dioxide refrigeration cycle 3A functions. Accordingly, the liquid carbon dioxide cooled by the cascade condenser 7 will go down because of the so-called "natural circulation" by utilizing the difference in fluid heads. The liquid carbon dioxide then passes through the flow adjust valve 8, and eventually reaches the evaporator 9A in order to carry out the desired refrigeration. The carbon dioxide liquid is then heated and vaporized at the evaporator 9A, and thus obtained carbon dioxide gas returns to the cascade condenser 7.

(2) Heating Operation

During heating operation, the ammonia cycle 2 will not function, and is stopped.

On the other hand, the switch valves 11*b* and 12*b* are opened, and the switch valves 11*a* and 12*a* are closed in the carbon dioxide cycle 3. Thus, only the carbon dioxide heating cycle 3B functions. Accordingly, the liquid carbon dioxide, which is heated and vaporized by the heat absorbing device 10, will go up because of the so-called "natural circulation" due to the difference in fluid heads. The vaporized carbon dioxide is then introduced to the radiator 9B in order to carry out the desired heating. The carbon dioxide gas is then cooled to be liquefied at the radiator 9B, and thus obtained liquid carbon dioxide passes through the flow adjust valve 8 and returns to the heat absorbing device 10.

According to the first and second embodiments discussed above, the present invention actively circulates the carbon dioxide medium in the carbon dioxide cycle 3 by cooling and heating thereof, in addition to the generation of natural circulation. Therefore, it is not necessary to provide a compressor in the carbon dioxide cycle 3. Consequently, the cascade condenser 7, evaporator 9 and 9A (radiator 9B) can be simply prepared by tube or plate, without using any large-sized pressure vessel. Because of its simple structure, even when the state inside the carbon dioxide cycle 3 becomes normal temperature and high pressure at about 75 $kg/cm^2$ (abs), it is technically and economically proven that the safety of the carbon dioxide cycle 3 can be easily secured.

The fluid pipe may be prepared by using relatively small diameter of pipe, since the latent heat of carbon dioxide is used inside the fluid pipe. For example, as compared with calcium chloride brine using the sensible heat, the required volume of liquid carbon dioxide at −20° C. is about between one fortieth and one ninetieth (1/40–1/90) of that of calcium chloride brine. Thus, the small diameter pipe can supply a sufficient volume of liquid carbon dioxide to the evaporator 9, 9A, by simply utilizing the difference of fluid heads of liquid carbon dioxide.

Figure 3:
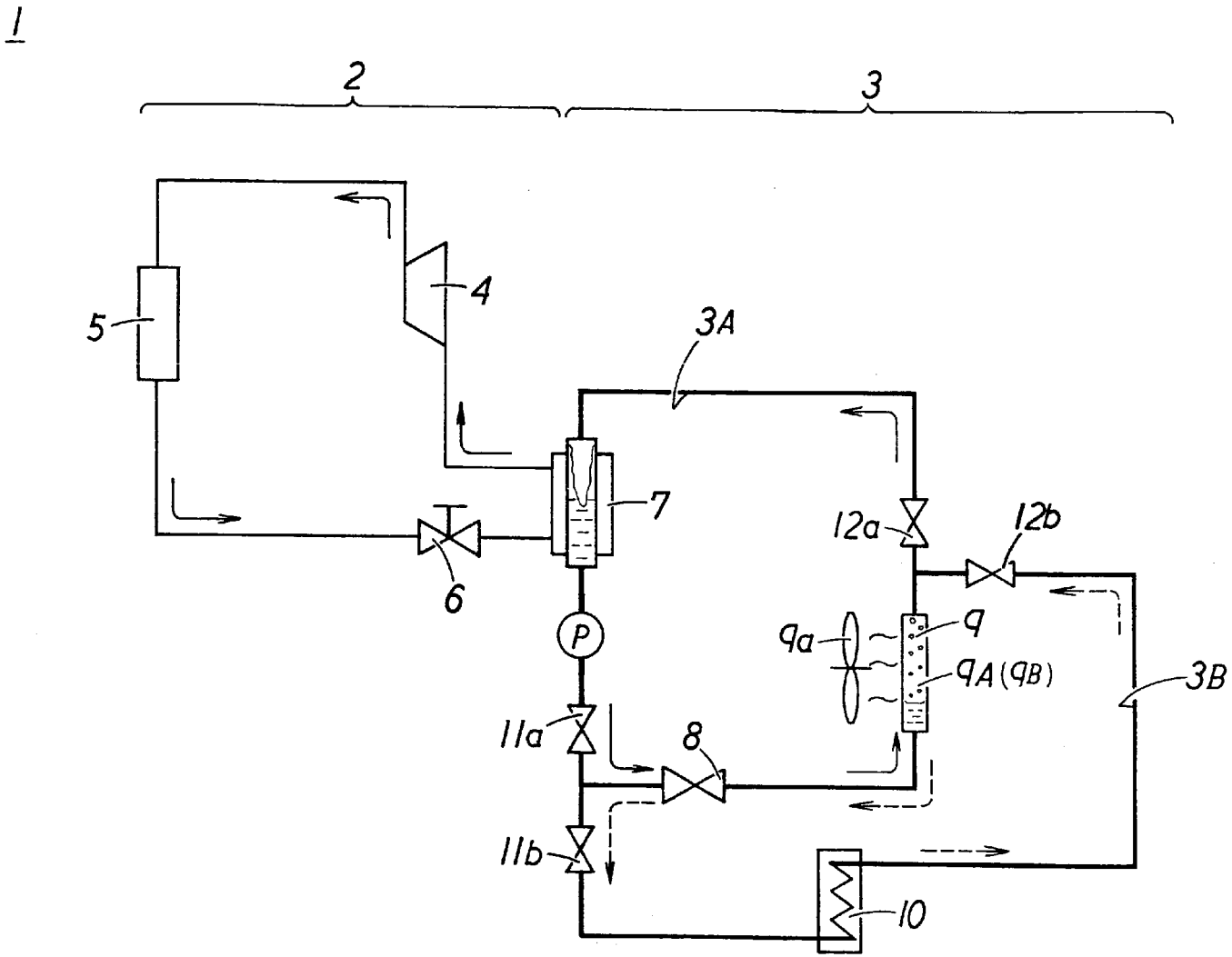
FIG. 3 is a block diagram showing the scheme of heat pump system according to the embodiment of the present invention further provided with the fluid pump for secondarily supporting the circulation of carbon dioxide medium.

If it is still desired to obtain much reliable circulation of carbon dioxide medium by support of secondary means, it is preferable to be provided with a fluid pump P in the cycle. Even when this fluid pump P is provided in the cycle, since the use of latent heat of carbon dioxide is still continued, less load power is required for the pump, thus economical operation can be realized without substantially deteriorating the overall heat exchange efficiency. For example, when the case of using calcium chloride brine at −20° C. is compared with that of using liquid carbon dioxide at the same temperature, the liquid carbon dioxide surpasses by 30% in the overall coefficient of performance including the consideration of the pump power required for maintaining the refrigerator at −15° C. When the fluid pump P is provided in the carbon dioxide cycle 3, the fluid pump P may be provided, e.g., right under the cascade condenser 7 as illustrated in FIG. 3.

OTHER EMBODIMENTS

Figure 4:
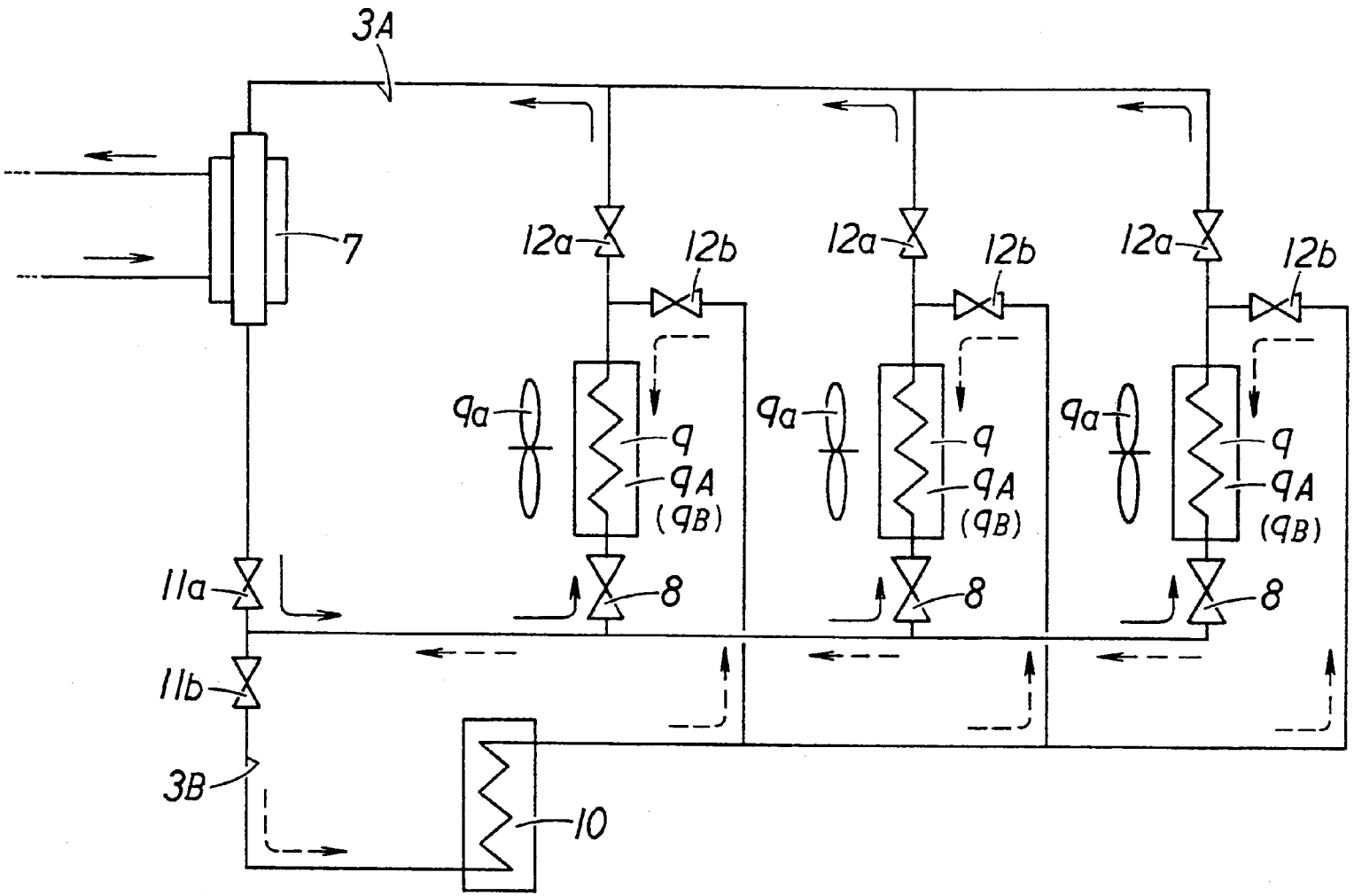
FIG. 4 is a block diagram showing the scheme of heat pump system according to the embodiment of the present invention provided with the plurality of desired evaporators (radiators) in place of the single refrigeration cycle (refrigeration/heating cycle)

Although the present invention basically relates to the technical ideas as discussed in the above embodiments, it is also possible to modify the present invention to the following embodiments without departing from the scope and spirit of invention. First, according to the first and second embodiments as illustrated in FIGS. 1 through 3, only the single evaporator 9, 9A (radiator 9B) carrying out the desired cooling and heating is provided for each refrigeration cycle or each refrigeration/heating cycle, but it is also possible to provide a plurality of evaporators 9, 9A (radiator 9B) as illustrated in FIG. 4, according to the number of rooms or the area of the room in which the cooling and heating are to be provided, or according to any condition such as the required refrigeration (or heating) capacity. In regard to the cycle shown in FIG. 4, for example, the plurality of flow adjust valves 8 may be united into the single flow adjust valve.

Figure 5:
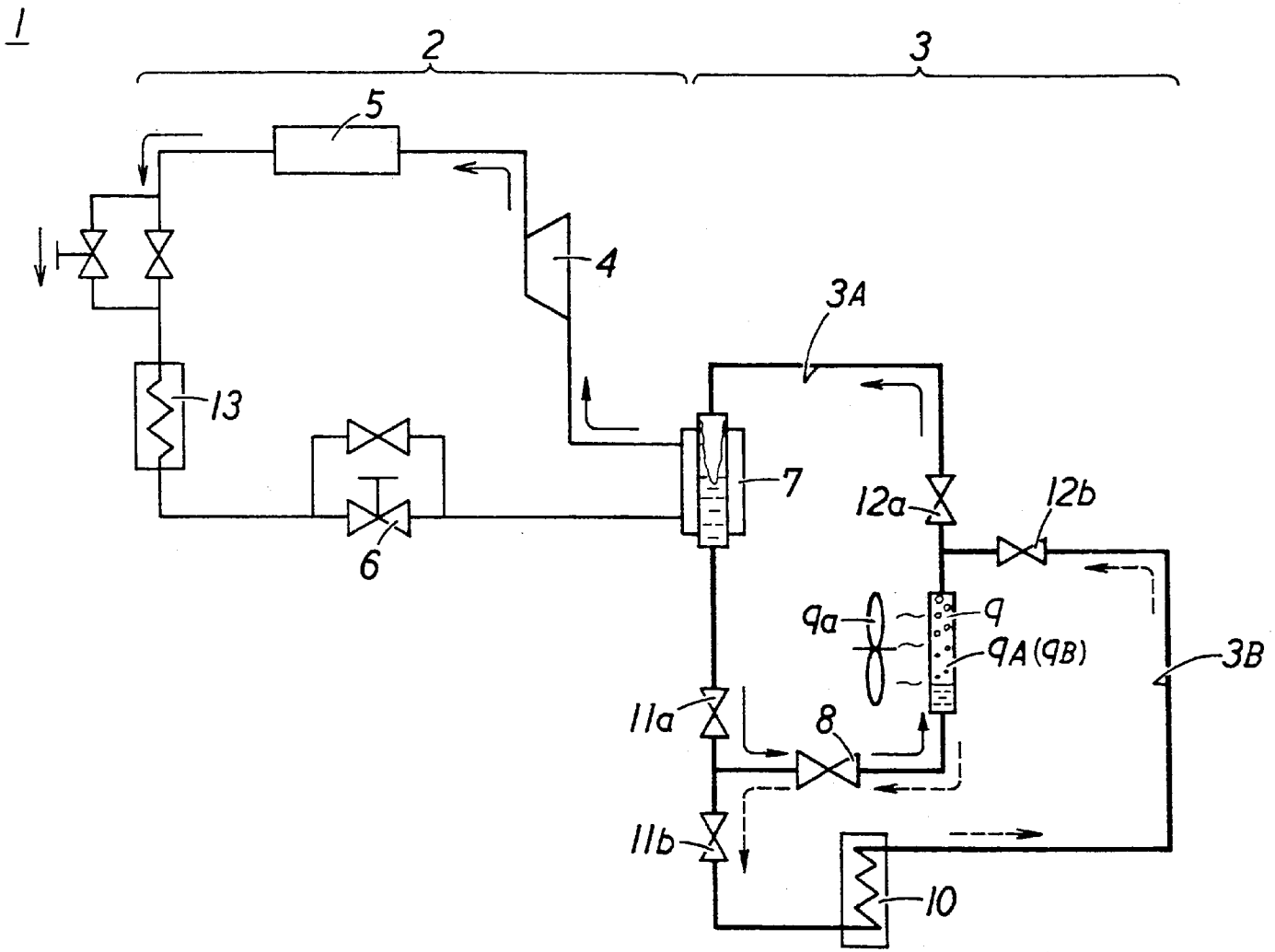
FIG. 5 is a block diagram showing the scheme of heat pump system according to the embodiment of the present invention provided with the thermal storage device in the ammonia cycle.

FIG. 5 illustrates another embodiment in which a thermal storage device 13 accommodating a thermal storage medium is provided in the ammonia cycle 2. Where the nighttime low-price electricity service (by which the electricity can be used at the lower cost than that of daytime use) is available, the thermal storage is done at night, so that the stored heat may be used in the daytime, and thereby the effective operation can be accomplished.

Figure 6:
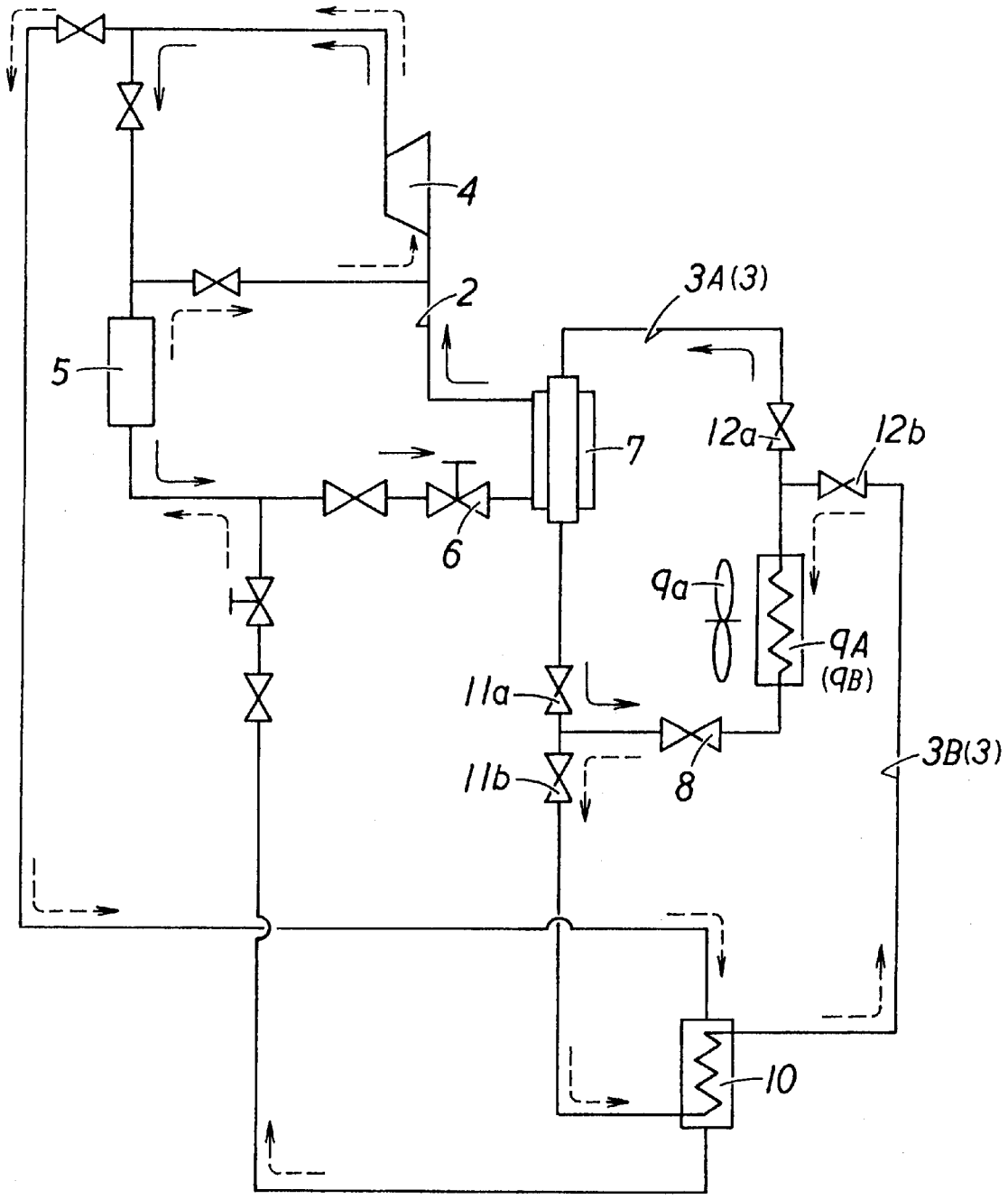
FIG. 6 is a block diagram showing the scheme of heat pump system according to the embodiment of the present invention in which the exhaust heat (heat of condensation) of the ammonia cycle is used as the heat source for the heat absorbing device in the carbon dioxide cycle.

Further, FIG. 6 illustrates another embodiment applicable to the refrigeration/heating apparatus, wherein the exhaust heat (heat of condensation) of the ammonia cycle 2 is used as the heat source for the heat absorbing device 10 in the carbon dioxide cycle 3, thereby more effective operation can be accomplished.

As above discussed, in the heat pump system according to the present invention, refrigeration or heating is carried out by a combination of an ammonia cycle and a carbon dioxide cycle, under natural circulation which does not necessitate the incorporation of a compressor in the latter cycle. Therefore, the heat pump system according to the present invention is in particular applicable to an apparatus of which production cost itself should be lowered, and by which the desired refrigeration and heating can be performed effectively.

What is claimed is:

1. A heat pump system for carrying out refrigeration or heating, said heat pump system comprising the combination of:

an ammonia cycle using ammonia as a fluid medium; and a carbon dioxide cycle using carbon dioxide as a fluid medium, wherein natural circulation is utilized in said carbon dioxide cycle without incorporating a compressor in said carbon dioxide cycle.

2. The heat pump system as claimed in claim 1, wherein the carbon dioxide medium is circulated in said carbon dioxide cycle due to a difference of fluid heads of the carbon dioxide medium and by heating or cooling a portion of said carbon dioxide cycle.

3. The heat pump system as claimed in claim 2, wherein said carbon dioxide cycle comprises a carbon dioxide refrigeration cycle which is operational during a cooling operation, and a carbon dioxide heating cycle which is operational during a heating operation.

4. The heat pump system as claimed in claim 3, wherein said carbon dioxide refrigeration cycle includes an evaporator for vaporizing the carbon dioxide, and a cascade condenser for cooling and liquefying the carbon dioxide, wherein said evaporator is disposed below said cascade condenser.

5. The heat pump system as claimed in claim 4, wherein said carbon dioxide heating cycle includes a radiator for condensing the carbon dioxide medium, and a heat absorbing device for heating and vaporizing the carbon dioxide medium, wherein said heat absorbing device is disposed below said radiator, and said radiator serves as the evaporator during a refrigeration operation, wherein circulation of the carbon dioxide medium is achieved by cooling and liquefying the carbon dioxide medium in said carbon dioxide refrigeration cycle by said cascade condenser during a refrigeration operation, and by heating and vaporizing the carbon dioxide medium in said carbon dioxide heating cycle by said heat absorbing device during a heating operation, wherein the ammonia medium in said ammonia cycle circulates through said cascade condenser during a refrigeration operation.

6. The heat pump system as claimed in claim 5, wherein structural elements of said ammonia cycle are located remotely from said evaporator of said carbon dioxide cycle.

7. The heat pump system as claimed in claim 4, wherein structural elements of said ammonia cycle are located remotely from said evaporator of said carbon dioxide cycle.

8. The heat pump system as claimed in claim 1, wherein said carbon dioxide cycle comprises a carbon dioxide refrigeration cycle which is operational during a cooling operation, and a carbon dioxide heating cycle which is operational during a heating operation.

9. The heat pump system as claimed in claim 8, wherein said carbon dioxide refrigeration cycle includes an evaporator for vaporizing the carbon dioxide, and a cascade condenser for cooling and liquefying the carbon dioxide, wherein said evaporator is disposed below said cascade condenser.

10. The heat pump system as claimed in claim 9, wherein said carbon dioxide heating cycle includes a radiator for condensing the carbon dioxide medium, and a heat absorbing device for heating and vaporizing the carbon dioxide medium, wherein said heat absorbing device is disposed below said radiator, and said radiator serves as the evaporator during a refrigeration operation, wherein circulation of the carbon dioxide medium is achieved by cooling and liquefying the carbon dioxide medium in said carbon dioxide refrigeration cycle by said cascade condenser during a refrigeration operation, and by heating and vaporizing the carbon dioxide medium in said carbon dioxide heating cycle by said heat absorbing device during a heating operation, wherein the ammonia medium in said ammonia cycle circulates through said cascade condenser during a refrigeration operation.

11. The heat pump system as claimed in claim 8, further comprising a fluid pump for secondarily supporting the circulation of the carbon dioxide medium in said carbon dioxide refrigeration cycle.

12. The heat pump system as claimed in claim 1, wherein structural elements of said ammonia cycle are located remotely from said carbon dioxide cycle.

13. The heat pump system as claimed in claim 1, further comprising a fluid pump for secondarily supporting the circulation of the carbon dioxide medium in said carbon dioxide cycle.

14. A heat pump system for carrying out refrigeration or heating, said heat pump system comprising the combination of:

an ammonia cycle using ammonia as a working fluid, said ammonia cycle comprising a compressor for compressing the ammonia, a condenser for receiving the ammonia from the compressor, a cascade condenser, and an expansion valve disposed between the compressor and the cascade condenser; and a carbon dioxide refrigeration cycle using carbon dioxide as a working fluid, said carbon dioxide refrigeration cycle comprising the cascade condenser for cooling the carbon dioxide in the carbon dioxide cycle, an evaporator, and a flow adjusting valve disposed between the cascade condenser and the evaporator, wherein natural circulation is achieved in said carbon dioxide refrigeration cycle by positioning cascade condenser at a level above that of the evaporator so that the fluid head of the carbon dioxide at the cascade condenser is different than the fluid head of the carbon dioxide at the evaporator.

15. The heat pump system as claimed in claim 14, further comprising a carbon dioxide heating cycle including the evaporator, which functions as a radiator during a heating operation, a heat absorbing device for heating and evaporating the carbon dioxide, and the expansion valve disposed between the evaporator and the heat absorbing device, wherein said ammonia cycle is stopped during a heating operation.

16. The heat pump system as claimed in claim 15, wherein switch valves are employed in said carbon dioxide refrigeration cycle and said carbon dioxide heating cycle so that only said carbon dioxide refrigeration cycle functions during a refrigeration operation and only said carbon dioxide heating cycle functions during a heating operation.

* * * * *